US005390934A

United States Patent [19]

Grassa

[11] Patent Number: 5,390,934

[45] Date of Patent: Feb. 21, 1995

[54] MULTIPLE POSITION PLAY TWENTY ONE GAME

[76] Inventor: Louis J. Grassa, 21 Marshall St., Somerville, Mass. 02145

[21] Appl. No.: 57,960

[22] Filed: Apr. 12, 1993

[51] Int. Cl.[6] ..... A63F 1/00

[52] U.S. Cl. ..... 273/292; 273/274

[58] Field of Search ..... 273/274, 292, 85 CP, 273/303

[56] References Cited

U.S. PATENT DOCUMENTS

| | | | |
|---|---|---|---|
| 4,397,469 | 8/1983 | Carter | 273/292 X |
| 4,861,041 | 8/1989 | Jones et al. | 273/292 |
| 5,072,946 | 12/1991 | Miller | 273/274 X |
| 5,154,429 | 10/1992 | LeVasseur | 273/292 |
| 5,174,579 | 12/1992 | Griffiths | 273/292 |
| 5,257,810 | 11/1993 | Schorr et al. | 273/292 |
| 5,280,915 | 1/1994 | Groussman | 273/292 |
| 5,288,077 | 2/1994 | Jones | 273/292 |

FOREIGN PATENT DOCUMENTS

| | | | |
|---|---|---|---|
| 9216269 | 10/1992 | WIPO | 273/292 |

OTHER PUBLICATIONS

"Pot O' Gold", Fortune Card 21, 2 pages, Dec. 1991.

*Primary Examiner*—William E. Stoll

*Attorney, Agent, or Firm*—Herbert L. Gatewood

[57] ABSTRACT

A multiple position play Twenty One or Blackjack card game is provided wherein a player can play not only his own hand against the dealer but by an extra play also those hands of other players at the table. Any player making an extra play is betting on the outcome of the cards of another player position, over which he has no control.

1 Claim, 1 Drawing Sheet

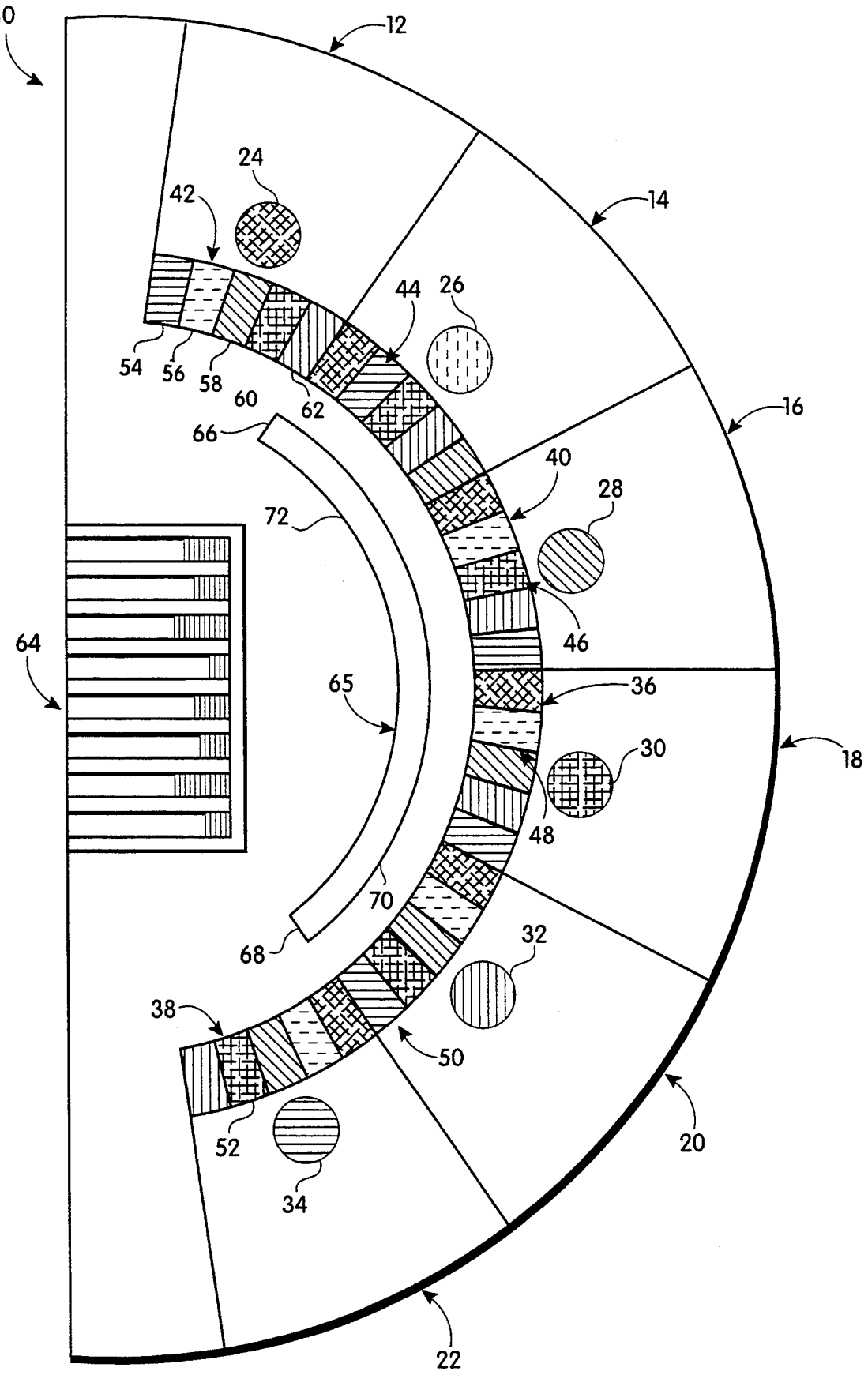
10
12
14
16
18
20
22
24
26
28
30
32
34
36
38
40
42
44
46
48
50
52
54
56
58
60
62
64
65
66
68
70
72

MULTIPLE POSITION PLAY TWENTY ONE GAME

BACKGROUND OF THE INVENTION

1. Field of the Invention

The present invention relates, in general, to a card game. More particularly, the invention relates to a modification of playing the card game "Twenty One". Even more particularly, the invention relates to a modified Twenty One game wherein a player has the opportunity for multiple position play, i.e., a player can play not only his own hand against the dealer but also the outcome of one or more other player's hands at the table, against the dealer.

2. Description of the Prior Art

The card game commonly known as "Blackjack" is believed to have originated in France where it is called "vingt-et-un," the English translation being "twenty-one." Blackjack is actually a specific holding in the game Twenty One, wherein two cards total 21, i.e., an ace together with a ten or a face card, as the first two cards dealt. The term "natural" (in Twenty One) is also used sometimes, instead of "Blackjack."

In Blackjack, the dealer (e.g., an employee of a casino or gambling establishment) deals, or gives, cards in turn to each of his opponents, i.e., a player and himself. Each player initially receives two cards, as does the dealer. One of the dealer's cards is dealt face down and the other card is dealt face-up. Both the player and the dealer have as an object to get as close as possible to a total card count of 21 without exceeding that value. The four suits of the deck of cards have no significance in the game. Cards numbered 2 to 9 held by a player each count at face value, in determining the total card count. Tens, jacks, queens, and kings each have a value of ten. These cards are commonly described as "10-value cards." An ace can be valued at either 1 or 11, at the player's option.

A player may, after receiving the first two cards (dealt face-down), draw additional cards (take "hits") in an effort to try and beat the count of the dealer's hand. In the event such an additional card drawn results in the player's card count exceeding 21, the player "goes over," or "busts." Thus, the player is out of the game. He loses. When a player "busts," he loses his wager regardless of the dealer's card count. A player may stand on any card count of 21 or less. A player having 21 on the first two cards dealt has "Blackjack," and wins. He is paid generally at 1½ times the bet wagered.

The game "blackjack" is commonly played in a casino by a dealer and up to seven players, located around a playing table having the shape of a semi-circle or a half-moon. The dealer is centrally located, at the center of the circle defining the shape of the table. The players are each located at a playing position or station, each being defined by two radii of the semi-circular shaped table. Thus, the playing table is divided into seven equally spaced positions whereby each player faces inwardly toward the dealer.

Blackjack, in its earlier days, was played with the usual single deck of fifty two (52) cards, the cards being dealt by hand. The use of such a single deck offers distinct advantages and possibilities to a player who is capable of remembering the cards played. Thus, such a player can alter his play strategy according to the count value of the relatively few cards left toward the end of the deal. To minimize this advantage to a player, casinos generally use a number of decks of cards, sometimes up to eight (8) decks, shuffled together to make a "deck" for play. Although such a manner of play favors the house, it has been determined that this is only by a fraction of a percent. Moreover, the dealer is not generally obligated by the casino to use such an "entire deck." The dealer may use, for example, two thirds, or even less of such a deck. The shuffled deck of cards are generally placed by the dealer in the casino in a device known as a "shoe," from which the dealer slides out the cards from the deck one-at-a-time.

The cards are shuffled in full view of the players, after which the dealer invites any one of the players to cut the deck. This is accomplished in usual practice by that player placing a plastic blank somewhere in the deck. Then, the dealer will generally re-cut the deck and place the cut card toward the end of the deck, according to usual practice.

The play of the game starts when each of the players has made a wager or bet. To make a bet, a player places either "chips," each having a certain dollar value, or currency in the so-called "wager box" located directly in front of him, or her. A notice provided on the game table sets the limits of a player's bet, e.g., $10—minimum/$1000—maximum. When a table has less than the total number of players allowed, e.g. all the playing positions or stations are not occupied by a player, any of the players at the table may place additional wagers in the empty playing positions. Thus, in such a case, the effect is that a player can play two, or even possibly more, games at the same time. The dealer merely plays against these phantom opponents in the usual way.

The deal in Twenty One begins when each of the players has made the desired bet, or wager. Thus, the top card is taken from the shoe, exposed to the players (in most cases the card is not exposed), and then "burned." Thus, that card is placed by the dealer to one side into the discard rack. The dealer then begins the deal, giving the next card removed from the shoe to that player sitting at his left-hand side, i.e., the first playing position on the semi-circular shaped table. The play continues in clockwise fashion around the table, one card being given to each player, and finally one to the dealer. These first cards dealt are face-up, the value of each player's cards being visible to the other players and the dealer.

The dealer then deals a second card to each player in turn, face down, and to himself. If the dealer's up card, i.e., the first card dealt, is a 10-value card, or an ace, he then looks at the second card dealt, i.e., the face-down or "hole" card. In some casinos, however, the dealer may not look at his hole card until later. A player likewise looks at his hole card to determine its count. When either the dealer or a player holds 21 in the first two cards dealt, by way of an ace and a 10-value card, he is said to hold "Blackjack." This can lead to special situations, later more fully disclosed. Depending, however, on the house or casino rules, the two cards dealt to a player may both be dealt face down.

If the dealer's hole card gives him "Blackjack," he turns over the hole card and play for that game ends. Any player who happens to also hold "Blackjack" turns his hole card or cards over and announces "Blackjack," just like the dealer. Such a player ties with the dealer. That player retains his bet. The other players not having Blackjack each lose their bet. A player holding Blackjack, the dealer not so holding, is generally paid at odds of 3 to 2, based upon the amount bet.

When each of the players has been dealt two cards, either face-up or face-down, and the dealer does not hold Blackjack, the dealer faces the first player to his left, (i.e., the player sitting at the first player's position on the table). This player will then signify to the dealer whether he wishes to "stand" on the two cards first dealt to him or be dealt, or "hit" with, another card. A player wishing to stand will, according to usual practice, slide his cards under his bet, when the cards have been dealt face down. On the other hand, when the cards have been dealt to a player, either-face-up or face-down, a player wishing to stand makes a negative gesture, e.g., by a sweeping or pushing motion of his right hand toward the dealer. Dealers in a casino are, in general, supposed to respond to hand gestures only. A player whose first two cards dealt total 17 or more will invariably stand. Nevertheless, a player may stand, and some do, on a lesser card count.

A player wishing to be hit with another card, i.e., a third, fourth, etc. card, in the hope of improving his present card count will signify such fact by word or hand gesture. The act of a scratching motion by the player, i.e., bending the wrist and fingers of his right hand with palm down toward himself in a sweeping action, conveys to the dealer that a further card should be dealt to him. Also, if the two cards are laying face down, waving the cards with such held in a player's right hand, not just one's fingers, conveys the same message to the dealer. A player may continue to ask that a further card be dealt to him and such will be dealt until he indicates to the dealer that he wishes to stand on that card count, or until his card count exceeds 21. Any cards dealt to a player or dealer beyond the first two cards are always face-up.

There are certain variations and procedures that are included in the conventional manner of playing Twenty One. One such a procedure involves "Splitting Pairs." Thus, when the first two cards dealt to a player are a pair, i.e. of the same value, he may "split" those two cards, if desired into separate hands. This allows the player to play two hands at the same time against the dealer. In most casinos, a player cannot make a further split. If a player splits his first two cards, he must make the same bet for the second time, as originally made. He then receives a new second card for each of the split hands.

Where the cards split by a player are aces, the player can receive only one (1) additional card for each hand, i.e., each card split. The dealer then deals to the first hand, i.e., first card split, according to usual play, before going to the second card split. Thus, the player must ask for additional cards to be dealt to the first card split, until he decides to stand, or goes bust. Then, the dealer deals cards to the second split in usual playing manner until the player signifies to the dealer that he wishes to stand or goes bust on that hand.

In another manner of play, a player may "Double Down" on any first two cards. Nevertheless, in some casinos, a "Double Down" play may be limited to the case where the player's first two card count totals 9, 10, or 11. A player in "Doubling Down" makes an extra bet, not to exceed his original bet. Both cards are turned face up, in front of the player. The dealer then deals the player only one additional card. On this three card count, whatever it is, the player must stand, unless such count exceeds 21. In this latter case, the player is out of the game, losing his double down bet to the dealer. If the player's cards are face down, when he loses, he turns them face up. The dealer then places these cards in the discard rack, at the same time taking the player's bet. In the event the cards are already face up, the dealer simply picks the cards up and places them in the discard rack, taking the bet in at the same time.

The player "Splitting Pairs" may "Double Down" on either of the split hands if he is eligible to do so under the "Double Down" rules. The player may, in conventional Twenty One, split again if he pairs up on either or both of the split hands, under the rules in some casinos. Also, in some casinos, a player need not have a pair in "Splitting Pairs;" he must merely have two cards each having a ten count, e.g. a ten and a jack. Nevertheless, as a 20 count hand is a good hand to have, most experienced Twenty One plays are reluctant to risk such a hand by "splitting."

After being dealt the first two cards, a player may, if he so desires, elect to "surrender" provided the casino allows such a manner of play. A player may, in usual circumstances, surrender if the first two cards dealt have a card count of 14, 15, or 16. These hands are commonly called "stiffs." The player surrenders half his bet.

When all the player's hands have been completed, i.e., a player's card count exceeds 21. i.e. he busts, or he stands on those cards dealt to him, the dealer then turns up his hole card. The dealer then plays out his hand according to the rules fixed by the house or casino. According to usual practice, the rule is that a dealer must draw an additional card, if his total card count is 16 or less. The dealer, on the other hand, must stand on a card count of 17.

If the dealer busts or loses, i.e., his taking one or more extra cards puts his card count at over 21, all players still in the game are paid at even money, the amount wagered. In the event the dealer and a player have the same total card count, the hand is considered a tie or "push". With such a happening the dealer or player may be paid the amount of the bet, depending on house rules. If the casino takes all "pushes," the dealer picks up the player's bet.

As will be readily appreciated from the above description of how to play Blackjack, the casino has a definite advantage. This is due to the fact that the dealer is the last to play. Thus, the dealer is the last to be subjected to the hazard of going bust, i.e., where his total card count exceeds 21. A dealer can sit back, doing nothing, while each of the players in turn may be subjected to such a risk, in order to get closer to 21. Of course, a player can avoid this risk by declining to be hit with a further card, when he realizes that receiving a high card, or one having a predetermined value, e.g., six (6) would put him at a card count of 22. The dealer, however, must stand at 17.

In another procedure involving conventional Twenty One, and as a manner of strategy, a player may take "insurance" against a dealer obtaining Blackjack. Thus, if the dealer's first card, which may be dealt face-up, or any second card dealt face-up, is an ace, this opportunity occurs. The opportunity of insurance occurs, however, only following the receipt by the players and dealer of the second card. On such a happening, the dealer will ask a player if he wishes to "take insurance." A player may, by taking insurance, hedge against the dealer having "Blackjack" by turning up a 10 value card (the hole card) to go along with the Ace, already face-up. Thus, the player insures that he will not lose in this event, by putting up a further wager half the value of the original bet. If the dealer, after insurance has been taken, turns up Blackjack, he pays out to the player 2 to 1 on the insurance bet. Thus, the player in effect gets back the amount of his bet, the dealer taking the player's initial wager. If the dealer does not turn up Blackjack, the insurance bet is lost by the player. The round of the game then continues.

As will be readily appreciated from the above disclosure, as to the conventional manner of play of Twenty One, a round of the game consists of one player's hand against one dealer's hand. Once a player draws his cards and "stands," he has only a single opportunity to win or lose. This is because the dealer is likewise playing only a single hand. The fact that a player may "Split Pairs" or "Double Down" may result in an additional play or increased bet results in some possible greater opportunity to the player in winning or winning an increased amount; however, both opportunities are somewhat limited. Naturally, the same opportunities exists for the dealer in the event the player loses.

Heretofore, one method of playing multiple action Twenty One or Blackjack has been known. For example, in U.S. Pat. No. 5,154,429, entitled METHOD OF PLAYING MULTIPLE ACTION BLACKJACK, which issued on Oct. 13, 1992, there is disclosed such a card game. A player in this game plays the same hand against two or more successively dealt dealer's hands.

To begin the game, as disclosed in that patent, each player makes one or more antes or bets, as desired, to be eligible to participate against each of the dealer's hands. Each player and the dealer are dealt two cards with at least one of the dealer's cards turned face-up. Each player and the dealer then take hits or stands according to the conventional manner of play of Twenty One. The dealer's first hand is compared to the player's first hand, i.e., the only hand to be dealt to a player. Winning player's wagers are paid and losing player's wagers are collected, but only relative to the player's first ante.

The dealer then discards his first hand except for his face-up card, and then, using the face-up card, the dealer deals himself a "second" hand according to the conventional manner of play of Twenty One. The dealer's second hand is compared to each of the player's same hand that each such player played against the dealer's first hand. Again, winning player's wagers are paid and losing player's wagers are collected, but only relative to the player's second ante. This manner of play continues for the number of multiple dealer's hands that are prescribed by the house rules.

Each player in this modified Twenty One game can make additional bets such as insurance or doubling down or splitting pairs, as desired by the player. This can be done not only on the first hand dealt to the player, but upon each subsequent hand or game for which the player is eligible. All of the additional wagering that a player desires to make is completed before the dealer begins the play of each of his hands. The player, nevertheless, only plays his hand once regardless of how many antes he has made to be eligible to play against the first, second, or third, etc., dealer's hands.

If the player busts on the single hand dealt to him, he automatically loses all bets that he has made. Moreover, he is out of the game. Nevertheless, if the player stands on his hand, his numerical card count is used against each of the sequential dealer's hands as they are played out.

Although this modified Twenty One game increases a player's opportunity to win more than once in a single round of play, it still has certain disadvantages. For example, although the player has the opportunity to play his hand more than once against the dealer in a single round of play, the player is nevertheless always playing the same hand. The dealer, however, plays different hands against a player's hand, the number of different hands depending upon the casino rules.

Moreover, from the casino's stand-point, the play of a round of the modified Twenty One game takes a somewhat predictable amount of time. The same as does the conventional manner of play.

Thus, there is still a need for a modified Twenty One game wherein a player has a greater opportunity to win and to win a greater amount without having to increase the amount of his bet or to play the same cards against the dealer who can play different hands. Also, from the perspective of the gambling casino, there is still a need for a modified Twenty One game which will give the casino the opportunity for greater revenue generated over a set period of time.

SUMMARY OF THE INVENTION

It is a primary object of the present invention to provide a modified manner of playing the card game Twenty One not having the disadvantages of known multiple action Twenty One games.

A further, and a major objective of the invention is to provide a modified Twenty One game wherein a player has the opportunity to maximize his bets and the gambling establishment has the opportunity to increase its income, hence profit generated per hour.

A further object of the invention is to provide a modified Twenty One game wherein the player has the opportunity to, in effect, play a plurality of different hands against the dealer, at one round of play.

The above objects are obtained, in general, in providing a modified Twenty One game wherein wagers are made by a player in conventional fashion, after which a player can make one or more extra plays by betting on the outcome of another player's hand against the dealer. The game is then played out and settlement made in conventional fashion, except that in making settlement the winning players must wait to collect their winnings until after the board is settled, i.e., the house has collected it winnings.

Quite advantageously, a player can play as many extra plays or positions against the dealer as there are players in the game. A player, moreover, cannot be shut out of any position that he desires to play, i.e., extra plays he desires to make, provided that he has made a wager first at his own position. Thus, the game of the invention offers greater diversification for a player.

A further advantage is that a player is still dealt only one hand, yet the modified game provides the perception or effect that he is playing a desired number of different hands against the dealer's one hand. Any player making an extra play is betting on the outcome of another player's hand or position against the dealer, an outcome over which that player has no control.

Of advantage, nevertheless, is that a player can, if it is so desired, choose to play only his or her position.

A still further advantage is that the modified Twenty One game of this invention is visually much different than conventional Twenty One or any multiple action Twenty One game of which I am aware, due to the unique layout of the table on which it is preferably played. The game of the invention, moreover, is visually easier for a player or others to follow than known multiple action Twenty One games.

An even further advantage is that the modified Twenty One game of the invention provides greater camaraderie among the players at the table and offers more fun and excitement to a player in the outcome of any particular round of play. It involves not only strategy but also a certain amount of mystery and does not become tedious and eventual.

Of further advantage also is that the present invention offers more action to the casino and a more efficient Twenty One table at peak load periods, resulting in a potentially greater profit or drop (money) to the casino. A game according to the invention can produce from 1080 to 1440 outcomes per hour. A player can play, if desired, from one to six outcomes per hand.

BRIEF DESCRIPTION OF THE DRAWING

For a better understanding of the present invention, reference should be made to the following detailed description of the invention, and its preferred embodiments, which is to be read in conjunction with the sole figure of the drawing. In the drawing there is shown a layout of a table according to one aspect of the invention for playing the modified Twenty One game disclosed herein.

DETAILED DESCRIPTION OF THE PREFERRED EMBODIMENTS OF THE INVENTION

Turning now to the sole figure of the drawing, there is shown therein a table 10 having the preferred layout for a game table that can be used in the multiple position play Twenty One game according to the invention. Table 10 is, in general, in the shape of a half-moon having a diameter of approximately 68 inches, the same as is a conventional Twenty One or Blackjack table. Nevertheless, as will be appreciated by those familiar with the playing of Twenty One in a gambling casino, the table 10 is very different visually from the conventional Twenty One game table.

As shown in the drawing, table 10 is provided with a layout that has six individual playing positions, or stations, 12, 14, 16, 18, 20, and 22. Each station is provided with a color coded betting location such as referred to by reference numerals 24, 26, 28, 30, 32, and 34. In this case, each betting location is a colored disc about 3" diameter; however, as will be more readily appreciated hereinafter, these betting locations can take other shapes. For example, the betting locations can be colored squares or circles. Moreover, if desired, the betting location can be of various colored insignias, as desired, e.g., colored logos or trademarks, colored letters, colored names, or colored numbers. The betting locations can be of any colored pattern desired. The main consideration is that each player's betting location be distinguishable from that of the other players.

The table 10 is further provided with a color bar 36 defined by inner and outer perimeters 38, 40, i.e. arcs or portions of circles being concentric to the center of the circle defined by the outer perimeter of table 10. The inner perimeter 38 of the color bar 36 defines the top of each player's playing position. The color bar 36 is divided into individual portions or units, each of which comprises a player's extra play location, these being referred to by reference numerals 42, 44, 46, 48, 50, and 52. Each player's extra play location is further subdivided into a number of subunits each comprising an extra play position for each of the other players, e.g., the positions 54, 56, 58, 60, and 62 in player position 12. Thus, in this specific embodiment of the invention, there are provided five (5) approximately rectangular-shaped extra play positions in each player's extra play location. The extra play positions in each of the extra play locations are color coded like those of each of the other players' betting locations. Thus, if the betting locations 12, 14, 16, 18, 20, and 22 are of the color blue, orange, purple, green, yellow and red, respectively, the extra play location 12 will have extra play positions 54, 56, 58, 60, and 62 colored orange, purple, green, yellow and red respectively. In other words, the extra play locations for each player position, for example, can be each of a color corresponding to the color of the other player's betting locations. Nevertheless, the particular colors chosen are not really critical to the game of the invention. The main thing is that a player's position be provided with extra play positions each corresponding to indicea identifying each of the other positions on the table.

As will be readily appreciated the two sides defining a player's playing position, e.g. position 12, can lie on a radius of the circle defined by the Twenty One table 10. Also, the two sides defining a player's extra play positions, e.g. extra play position 54, can be defined by a radius, as indicated in the drawing. The player's playing position and extra play positions need not necessarily be so defined, as will be readily appreciated; however, the half-moon shape of the Twenty One table shown in the drawing readily lends itself to such a layout, and is preferred.

Although six separate player's positions e.g. positions 12, 14, 16, 18, 20, and 22, are provided for on the table shown in the drawing, this need not be the case. Nevertheless, such is more preferred. This number of positions provides adequate and a comfortable amount of space for each player. Nevertheless, it will be appreciated that there need not always be six players in any one game. Some player positions may be unoccupied. For the multiple position Twenty One game of the having all the player positions occupied invention, however, this is most preferred as such will allow for maximum participation by the players. It will also provide for more efficient operation by the gambling establishment.

Table 10 is further defined by a chip rack 64 as conventionally provided on a Twenty One table. The dealer, not shown in the drawing, is generally located at the center of the table 10, i.e., directly behind the middle of the chip rack 64. Although the table 10 can be of a somewhat larger diameter than earlier disclosed, and provide for a greater number of player positions, if desired, a larger table will be less suitable to most dealers. With the conventional size Twenty One table, as preferred in the play of the game of this invention, i.e. a half-moon-shape having a radius of approximately 34 inches, a dealer will be, in general, more comfortable. Thus, the length from each player's position is such that a dealer can readily deal the cards to all the player's positions without having to reach too great a distance, particularly without having to move from his center position. The color bar 36 will extend from the outside edge of player position 12 to the outside edge of player position 22, as shown in the drawing, a distance measuring approximately 54 inches, end-to-end, such distance being determined by the imaginary arc located midway between the inner and outer perimeter lines 38, 40. The color bar 36, as earlier disclosed is divided into equal length portions each comprising a plurality of extra play locations, depending upon the number of playing positions. Each color bar portion or extra play location is provided with the same number of extra play positions, i.e., the total number of player positions minus one.

Provided further on the more preferred table according to the invention is an insurance bar 65, the purpose for which will be later more fully disclosed, if not already known. The insurance bar 65 is defined by ends 66, 68, which lie on a radius of the circle defined by the table 10 and inner and outer sides or perimeters 70, 72. The inner and outer curved sides 70, 72, as shown in the drawing, are parallel respectively to inner and outer perimeter lines 38, 40 of color bar 36. These sides are parts of a circle having concentric centers to the circle defining table 10. A radius of that circle will divide the insurance bar and color bar in half. And three player positions, each of the same size, will be provided on each side of that radius dividing the color and insurance bars in half. Although not shown in the drawing, the insurance bar 65 can be divided up into equal portions, if desired, depending on the total number of player positions. Each portion or subdivision can then be color coded according to the color of each player's betting location. The insurance bar, if desired, can extend a greater length, e.g., its ends being on the same radii as that determining the edges of a playing location. However, as shown, insurance bar 65 is aesthetically appealing.

Further, although not shown in the drawing, a discard rack can be provided for, if desired, as is conventionally done. This can be located anywhere convenient to the dealer. The player betting locations, as earlier disclosed, can merely identify a player location, if desired. In that case, a separate wager box, or betting location, e.g., betting location 24, can be provided on table 10 for each player position, located, e.g., directly in front of the top of the player position, beyond that player's extra play location. This wager box can be a colored square, for example, color coded the same as the player's playing position identifier. Thus, if desired, the colored disc comprising betting location 24 can serve merely to identify that player position. In that case, a betting position or location for that playing position, e.g. colored disc, square, etc., can be provided on the table 10 directly between the dealer and a respective player position, just above the extra play location.

As shown in the drawing, the outer edges of the outer player positions 12, 22 are located inwardly from the diameter of the table, i.e., the straight inner edge defined by table 10. This is desirable so that these players are more readily visible to the dealer.

The modified Twenty One game of the invention is started by each player at the table making his bet as usual in the conventional Twenty One game. The bet made is placed on the player's betting location. For example, the player at playing position 12 would place his bet, chips or currency, as allowed by the gambling establishment, on the betting location 24.

Once each of the players has placed his bet on his own betting location, the dealer then announces that the players can each make extra plays, if desired. Each player can then make as many extra plays as there are other players or positions provided for at the table. The unique color bar 36 provided makes it possible for a player to bet on the outcome of any other position provided on the modified Twenty One game table 10. Even if a player position is not occupied, other players can make extra bets on that position, provided such a position is first played additionally by one of the players as in conventional Twenty One, assuming house rules allow.

An extra play is made by a player placing a wager in one or more of the extra play positions located in front of him at the top of his player position in the extra play location. Thus, for example, the player at player position 12 can make a bet on the outcome of player position 22, if desired. Or that player can make a bet against the outcome of all the other player positions on table 10 against the dealer, as well as the bet made for his own position. Thus, quite advantageously, it is possible that six players at the table, each betting extra plays on each of the other player positions, can produce from about 30–50 hands or rounds per hour with from about 1080–1440 outcomes per hour, according to the game of the invention. By contrast, a conventional Twenty One game with seven players at a table can produce only about 50 hands/hour with only about 350 outcomes.

Once each of the players has made the number of extra plays desired, the game is then played out in conventional fashion. Any player making an extra play is betting on the outcome of another player position, a position or hand over which he has no control. A player, nevertheless, has full control over his own player position. The player plays the cards dealt to him in the same manner that he would in a conventional Twenty One game. For example, the player at player position 16 controls the play of the hand dealt to that position, even though each of the players at each of the other player positions, e.g., positions 12, 14, 18, 20, and 22 are betting against the outcome of the cards dealt to the player at position 16.

If a player, i.e., the positional player, e.g. the player at player position 16, chooses not to split pairs or double down, any other player making an extra play on that position has no choice. The players making extra plays e.g. the players at positions 12, 14, 18, 20 and 22, cannot force a positional player e.g. the player at position 16, to split pairs or double down. Nevertheless, if the positional player is eligible to and chooses to split pairs or double down, according to the house rules, an extra play player has two choices. The extra play player can mirror the action of the positional player or choose not to do so, as desired. The extra play player in mirroring the action of the positional player merely has a choice to make or not make a wager, accordingly. Any extra play wager made by such a player will depend largely upon house rules. For example, the extra play player may be required to make an extra play wager equivalent to that of his initial wager i.e., the amount wagered on his own hand, or that amount wagered by the positional player on which he is betting, or any portion thereof, e.g. at least half. Or the positional player may be allowed to make extra play wagers in any amount desired, including different amounts on each other positional player.

Settlement in the modified Twenty One game according to the invention is made according to the rules for a conventional game. For example, if a positional player has Blackjack on the first two cards dealt to him, he wins, provided the dealer does not also have Blackjack. In the latter case, a push may exist and be settled according to house rules. If the dealer has Blackjack on the first two cards dealt, the positional player loses, if he does not also have Blackjack. Or, if the positional player stands for example on 19 and the dealer has a lesser card count the positional player wins, as is conventional.

If the positional player 12, for example, makes an extra play on position 20, the positional player 12, as an extra play player, will win the extra play only if the positional player 20 wins. Nevertheless, it is highly preferred that any extra play winnings or settlements for a positional player be deferred until after the dealer has collected all the house winnings for the positional play. Thus, any extra play settlements will only occur after the game is played out in conventional fashion.

As will be readily appreciated by those familiar with the game Twenty One, the house can make various options or rules with respect to the play of the modified game according to the invention. It is preferred, however, and of some advantage to the house that the following be allowed: insurance, double down any first two cards, double down after splitting, the number of extra plays be limited only by the total number of player positions provided, and no limit on extra play bets, other than a table limit. The rules should not, it is believed, in the more preferred embodiment of the invention, allow for surrender or resplitting. In some cases, a casino may find it advantageous to allow a person standing behind a player position to also make extra play betting. Thus, such a person could make one or more extra play wagers, the same as the positional player.

It will be readily appreciated by those skilled in the art that the game of the invention can be readily provided in an electronic version. Thus, such a game can display the various player positions, e.g., a table displayed like that disclosed herein. And, a color bar or the like displayed can allow players to make extra bets. The dealer, as in presently known video Twenty One games, can be replaced by computer hardware and software, according to known techniques.

As will be readily understood by those skilled in the art, various modifications and changes can be make in the invention disclosed herein, and its form and construction, without departing from the spirit and scope thereof. The embodiments of the invention disclosed herein are merely exemplary of the various modifications that the invention can take and the preferred practice thereof. It is not, however, desired to confine the invention to the exact manner of players disclosed nor the table construction, layout, and features shown and described herein, but it is desired to include all such as properly come within the spirit and scope of the invention disclosed and claimed.

What is claimed is:

1. A method of playing a Twenty One card game wherein each player at any one playing position can make a wager against the dealer and can make additional wagers against the dealer by betting on the outcome of any other playing positions against the dealer comprising:

(a) providing a table for playing the card game, said table being defined by a multiple number of playing positions, a betting location being provided in each said position characterized by means identifying that playing position, and an extra play location being provided in each playing position, said extra play location being defined by means identifying each of the other playing positions;

(b) each player at each playing position making a wager against the dealer and placing such in the betting location provided at that playing position;

(c) the dealer than announcing that each positional player can make an extra play against the dealer along with the player at any of the other playing positions;

(d) each positional player then making additional wagers against the dealer by betting along with any other positional player, the wager being placed by the positional player in the extra play location identifying each other positional player wagered on; and (e) playing the game out in usual manner for playing a conventional Twenty One game.

* * * * *

UNITED STATES PATENT AND TRADEMARK OFFICE

CERTIFICATE OF CORRECTION

PATENT NO. : 5,390,934
DATED : February 21, 1995
INVENTOR(S) : Louis J. Grassa

It is certified that error appears in the above-indentified patent and that said Letters Patent is hereby corrected as shown below:

In column 8, line 41, the sentence starting therein and ending at line 45 should read -For the multiple position Twenty One game of this invention, however, having all player positions occupied is most preferred as such will allow for maximum participation by the players.-

Signed and Sealed this
Ninth Day of May, 1995

*Attest:*

*Attesting Officer*

BRUCE LEHMAN

*Commissioner of Patents and Trademarks*